US005999774A

United States Patent [19]

Masuda et al.

[11] Patent Number: 5,999,774

[45] Date of Patent: Dec. 7, 1999

[54] SERIAL ELECTROPHOTOGRAPHIC APPARATUS

[75] Inventors: Syuzo Masuda, Saijo; Ryouichi Iwama, Kawasaki, both of Japan

[73] Assignee: Fujitsu Limited, Kanagawa, Japan

[21] Appl. No.: 08/890,889

[22] Filed: Jul. 10, 1997

Related U.S. Application Data

[63] Continuation of application No. 08/458,285, Jun. 2, 1995, abandoned.

[30] Foreign Application Priority Data

Jul. 29, 1994 [JP] Japan ..... 6-179304

[51] Int. Cl.[6] ..... G03G 15/18

[52] U.S. Cl. ..... 399/155; 399/338; 219/216; 219/675

[58] Field of Search ..... 219/216, 667, 219/668, 632, 619, 674, 677, 675; 399/336, 33, 335, 155, 338

[56] References Cited

U.S. PATENT DOCUMENTS

| | | | |
|---|---|---|---|
| 3,973,105 | 8/1976 | Tsumori | 219/668 X |
| 4,570,044 | 2/1986 | Kobayashi et al. | 219/216 X |
| 4,610,526 | 9/1986 | Aser . | |
| 4,639,749 | 1/1987 | Ito . | |
| 4,845,519 | 7/1989 | Fuse | 355/212 X |
| 4,970,551 | 11/1990 | Moore | 355/212 |
| 5,196,870 | 3/1993 | Itoh et al. | 355/212 X |
| 5,461,463 | 10/1995 | Iwama | 355/210 |
| 5,488,452 | 1/1996 | Iwama | 399/1 |
| 5,506,666 | 4/1996 | Masuda et al. | 355/282 |

FOREIGN PATENT DOCUMENTS

| | | |
|---|---|---|
| 61-152463 | 7/1986 | Japan . |
| 01239790 | 9/1989 | Japan . |

*Primary Examiner*—Robert Beatty
*Attorney, Agent, or Firm*—Armstrong, Westerman, Hattori, McLeland & Naughton

[57] ABSTRACT

A serial electrophotographic apparatus has a carriage which is translated in a direction perpendicular to a direction in which recording paper is transported, a processing part effects electrophotographic printing, and a fixing unit effects fixing, wherein a fixing roller is heated by an induction coil according to an induction heating process, and a current supplied to the induction coil is cut off by a temperature fuse being blown when the temperature of the induction coil rises above a predetermined level. The induction coil has a configuration including multiple flat winding layers serially connected together and wherein ends of the induction coil are led out from the center of the windings so that temperature rise is restrained.

26 Claims, 9 Drawing Sheets

SERIAL ELECTROPHOTOGRAPHIC APPARATUS

This application is a file wrapper continuation of application Ser. No. 08/458,285 filed Jun. 2, 1995, now abandoned.

BACKGROUND OF THE INVENTION

1. Field of the Invention

The present invention relates to serial electrophotographic apparatuses, and more particularly to a serial electrophotographic apparatus in which a latent image is formed on a recording drum, and toner is used to print a visible image on recording paper.

A demand for inexpensive and compact electrophotographic apparatuses has resulted in the development of serial electrophotographic printers. In electrophotographic printers, a carriage for carrying a printhead is capable of performing an electrophotographic process. In these electrophotographic printers, recording paper is transported in a direction perpendicular to a direction in which the carriage is translated so that a transferring unit effects an image transfer onto the recording paper. A roller shaped fixing unit disposed ahead of the carriage in the direction of transportation effects fixing. In such a printer, safety measures must be taken against the heat generated within.

2. Description of the Prior Art

FIGS. 1A and 1B show a construction of a conventional serial electrophotographic printer 11, FIG. 1A being a partial top view of the printer, and FIG. 1B being a cross-sectional view of a carriage.

The serial electrophotographic printer 11 shown in FIGS. 1A and 1B is disclosed in Japanese Laid-Open Patent Application No. 61-152463. In the electrophotographic printer 11, a shaft 14 is disposed parallel with rollers 13*a* and 13*b* for transporting recording paper 12. A carriage 15 is driven by a motor (not shown) and guided by the shaft 14 to be movable in a direction perpendicular to a direction in which the recording paper is transported. A fixing unit 16 longer than the width of the recording paper 12 is fixed ahead of the carriage 15 in the direction in which the recording paper is transported. The fixing unit 16 may be equipped with a halogen lamp as a heat source. A transferring unit 17 is disposed below the recording paper 12 to lie in the direction in which the carriage 15 is transported.

The carriage 15 carries an image carrying body (recording drum) 21 which is rotated at a peripheral speed synchronized with the movement of the carriage 15. The surface of the image carrying body 21 is uniformly charged by a charger 22 (a charging roller) 22, and an electrostatic latent image is formed by an exposer 23. The electrostatic latent image is made visible to become a toner image by a developing roller 26 which is formed adjacent to the image carrying body 21 and supplies toner 25 stored in a developing unit 24 to the image carrying body 21. Toner image formed on the image carrying body 21 is transferred to the recording paper 12 by the transferring unit 17 disposed opposite to the image carrying body 21, the recording paper 12 being led through a space between the image carrying body 21 and the transferring unit 17. The recording paper 12 is transported so that a part which has undergone a transferring process faces the fixing unit 16, whereupon the image is fixed.

Excessive increase in the temperature of the fixing unit 16 is usually prevented by disposing a temperature fuse or the like in the neighborhood of the heat source, and by stopping the power supply in the event of an excessive increase in the temperature.

The applicants proposed a serial electrophotographic printer in which the fixing unit is mounted in the carriage, and fixing is done by rotating a fixing roller in cooperation with the recording drum, and in which an induction heating coil provided separately is used as a means to heat the fixing roller in a non-contact manner (Japanese Patent Application No.5-217609).

Induction heating is a method whereby magnetic flux generated by the induction coil is applied to the fixing roller so that an eddy current generated within the fixing roller and an electric resistance of the fixing roller interact to produce heat. Since the coil is a conductive body, an eddy current is generated in the coil itself, resulting in a disadvantage that the induction coil itself is heated due to Joule heat generated by a high-frequency current that flows in the coil and the eddy current.

The high-frequency current supplied to the coil is usually large and the magnetic flux density in the induction coil disposed in a narrow space is high. Thus, the eddy current generated in the coil is large (heat becomes more intense toward the center of the coil, thus producing greater heat therein than at the ends). Hence, the heat produced in the induction coil itself becomes large, thus causing the temperature of the induction coil and the neighborhood thereof to rise. This rise in the temperature demands that some safety measures be taken.

SUMMARY OF THE INVENTION

Accordingly, a general object of the present invention is to provide a serial electrophotographic apparatus in which the aforementioned problem is eliminated.

A more specific object of the present invention is to provide a serial electrophotographic apparatus in which a temperature rise is restrained and safety measures are taken in the event of an excessive rise in the temperature.

In order to achieve the aforementioned objects, the present invention provides a serial electrophotographic apparatus comprising: transporting means for transporting recording paper; a carriage equipped, at least, with processing means for exposing an image carrying body rotated about an axis parallel to a direction in which the recording paper is transported, forming a latent image by charging the image carrying body, and developing the latent image to produce a visible image; transferring means which, provided in such a position that the recording paper is led through a space between the carriage and the transferring means, transfers the visible image onto the recording paper as the carriage is being translated; translating means for translating the carriage above the transferring means, in a direction perpendicular to the direction in which the recording paper is transported; fixing means for fixing the visible image transferred onto the recording means by a heated fixing member; a heating member for heating the fixing member; and temperature control means for detecting a temperature of the heating member and restraining a temperature rise thereof. According to the serial electrophotographic apparatus of the present invention, a carriage is moved in a direction perpendicular to a direction in which recording paper is transported, a fixing member is heated by a heating member according to an induction heating process, and a temperature control means detects a rise in the temperature of the heating member so as to control or cut off a current supplied to the heating member in the event of an excessive temperature rise. In this way, a temperature rise of the heating member is restrained, and it becomes possible to take safety measures in the event of an excessive temperature rise.

In a preferred embodiment of the present invention, radiator means is provided in the heating member so that heat is radiated from the heating member. In this way, it becomes possible to restrain a temperature rise.

In another preferred embodiment of the present invention, the temperature control means is provided in the neighborhood of the radiator means. In this way, it is possible to take safety measures in the event of an excessive temperature rise in the heating member.

In still another preferred embodiment, the heating member for heating the fixing member according to an induction heating process is constituted such that a predetermined number of coil layers are formed by winding a wire member on planes associated with the respective layers. In this way, it is possible to improve a heat radiating capability and to restrain a temperature rise.

In yet another preferred embodiment, at least one end of the entirety of the above-mentioned coil layers is led out near the center of the plane of the wound wires. In this way, it is possible to efficiently radiate heat in the center.

DESCRIPTION OF THE PREFERRED DRAWINGS

Other objects and further features of the present invention will be apparent from the following detailed description when read in conjunction with the accompanying drawings, in which.

DESCRIPTION OF THE PREFERRED EMBODIMENTS

Figure 1A:
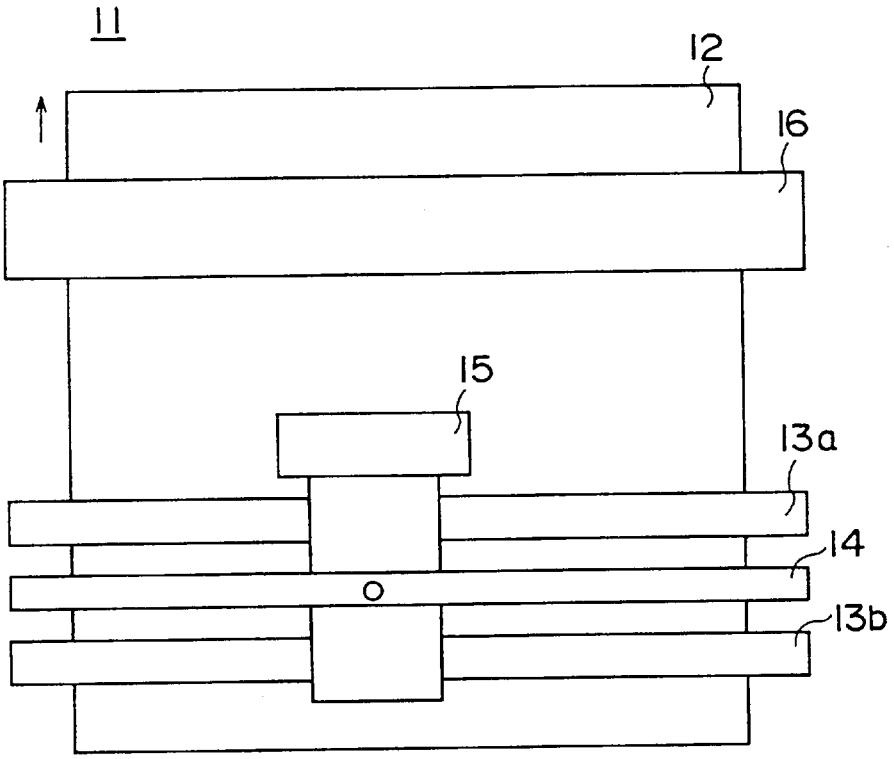
FIG. 1A PRIOR ART
FIGS. 1A and 1B show a construction of a conventional serial electrophotographic printer.
Figure 1B:
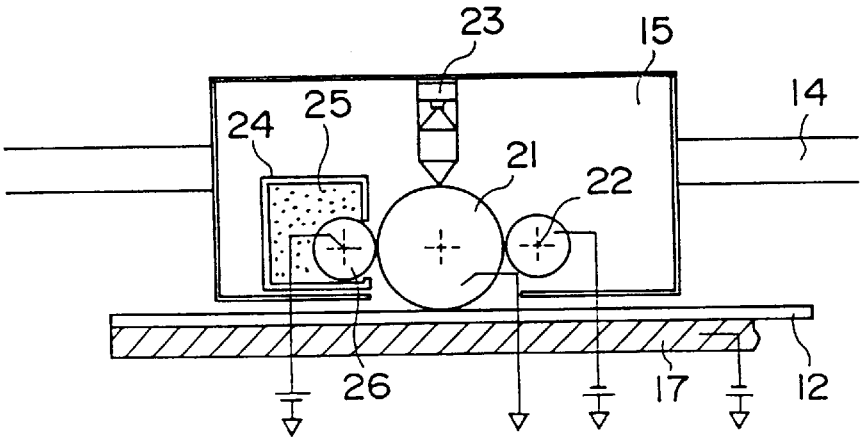
FIG. 1B PRIOR ART
Figure 2A:
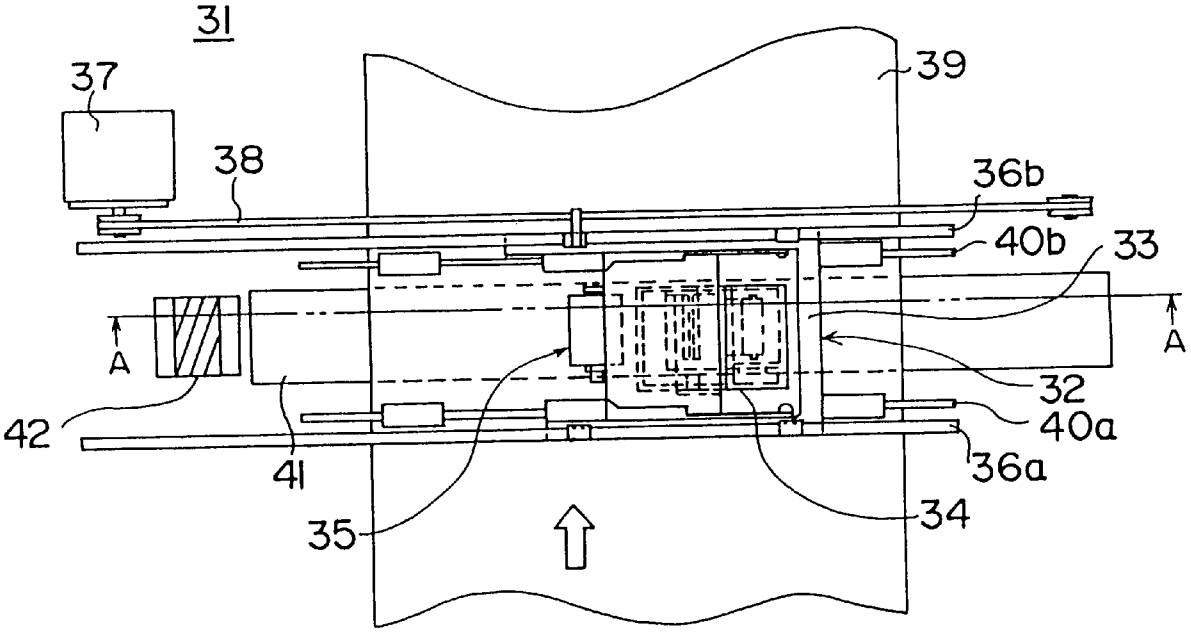
FIGS. 2A and 2B show a construction of a first embodiment of the present invention.
Figure 2B:
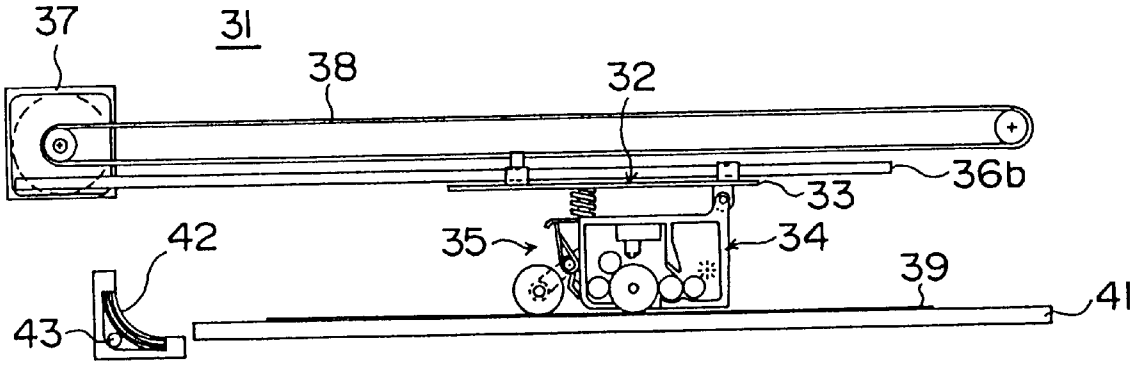
Figure 3A:
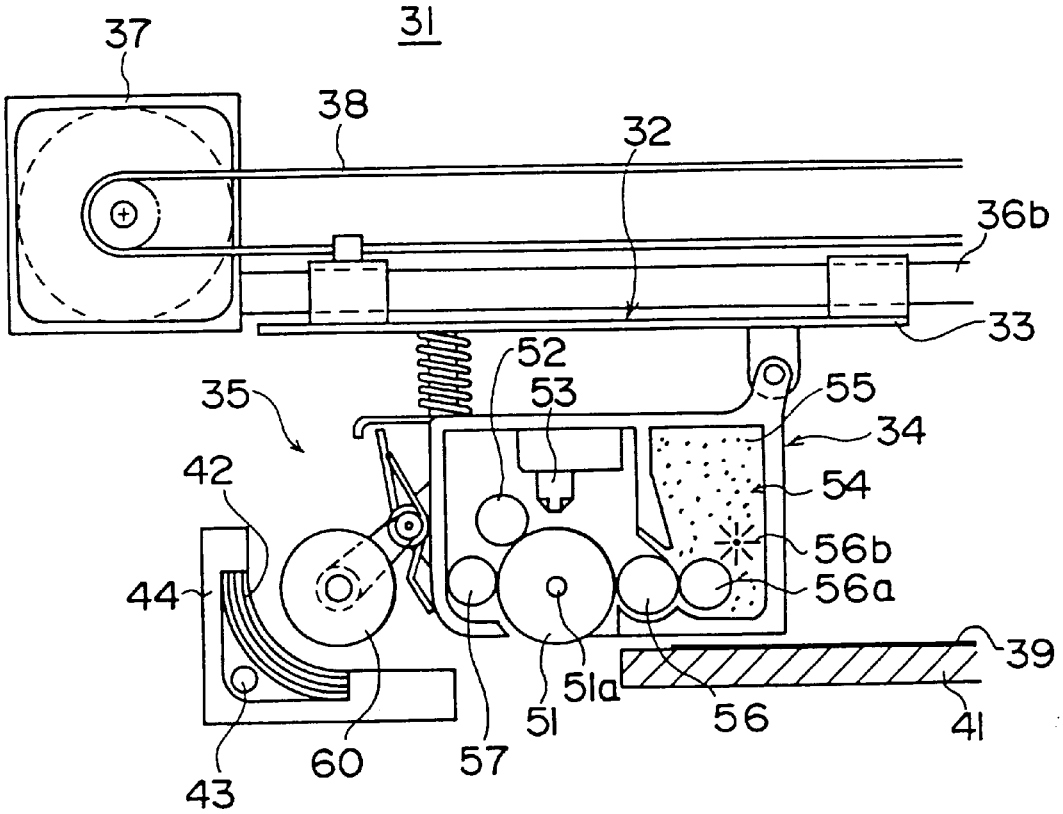
FIG. 3A is a diagram explaining a carriage of FIGS. 2A and 2B.
Figure 3B:
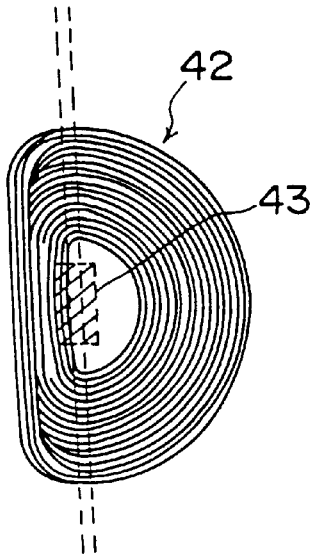
FIG. 3B is a diagram explaining a heating member of FIGS. 2A and 2B.

FIGS. 2A and 2B show a construction of a first embodiment of the present invention. FIG. 2A is a top view, and FIG. 2B is a cross-sectional view taken along the line A—A of FIG. 2A. FIG. 3A shows a carriage of FIGS. 2A and 2B, and FIG. 3B shows a heating member of FIGS. 2A and 2B.

FIGS. 2A and 2B show a serial electrophotographic printer 31 as a specific example of an electrophotographic apparatus. A carriage 32 is constructed such that a processing part (processing means) 34 and a fixing part (fixing means) 35 are mounted to a sliding part 33.

The sliding part 33 is guided by guide shafts 36*a* and 36*b* and driven by a carrier motor (translating means) 37 via a belt 38 so as to move in a direction perpendicular to a direction in which recording paper 39 is transported. The recording paper 39 is transported in a direction indicated by an arrow by means of rotating shafts (transporting means) 40*a* and 40*b* (a driving motor for driving the rotating shafts is omitted from the illustration).

A transferring unit (transferring platen) (transferring means) 41 is disposed beneath the carriage 32 to lie in the direction in which the carriage 32 is translated. The transferring unit 41 is produced such that a heat-resistant conductive member (for example, a silicone rubber having conductive material mixed therein) is formed on a substrate made, for example, of an aluminum, so as to face the carriage 32. The recording paper 39 is transported through a space between the transferring unit 41 and the carriage 32.

As shown in FIG. 3A, the processing part 34 of the carriage 32 has a recording drum (image carrying body) 51 built therein, the drum 51 having a rotation axis 51*a* extending parallel to the direction in which the recording paper 39 is transported and being rotated on the recording paper 39 lying on the transferring unit 41 at a peripheral speed synchronized with the translation of the carriage 32.

The surface of the recording drum 51 is uniformly charged by a charger 52, and has an electrostatic image formed on its surface by an exposer 53 disposed above the recording drum 51. The electrostatic latent image is turned into an toner image (visible image) by toner 55 being applied by a developing roller 56 to the recording drum 51, the toner 55 being stored in a developing unit 54. The toner image formed on the recording drum 51 is transferred to the recording paper 39 by applying a predetermined voltage between the recording drum 51 and the transferring unit 41 that sandwich the recording paper 39. The developing roller 56 is made to rotate in synchronism with the rotation of the recording drum 51.

The developing unit 54 is equipped with a supplying roller 56*a* which is in contact with the developing roller 56 so as to supply toner thereto, and a paddle 56*b* for stirring the toner.

A cleaner 57 is provided to eliminate leftover toner attached to the recording drum 51.

The fixing part 35 mounted to the carriage 32 together with the processing part 34 is equipped with a fixing roller 60. The fixing roller 60 is formed of a magnetic material such as an iron and has a mold release material such as Teflon coated on its surface so that the toner 55 does not get attached on its surface. A thermistor (not shown) is provided in the fixing roller 60 as a temperature detector.

An induction coil 42 (heating member) is provided in a holder 44 so as to be adjacent to the fixing roller 60 of the fixing part 35 when the carriage 32 is located at an initial position (home position) at which the printing is started. The induction coil 42 is curved into an arc shape so as to match the outline of the fixing roller 60. A temperature fuse (temperature control means) 43 is provided adjacent to the induction coil 42.

As shown in FIG. 3B, the induction coil (described with reference to FIGS. 4A and 4B) 42 is formed of turns of a coil (described with reference to FIGS. 4A and 4B). The magnetic flux generated by a current flowing in the coil is applied to the fixing roller 60 so that heat is produced in the fixing roller 60 according to an induction heating process. The temperature fuse 43 detects a rise in the temperature of the induction coil 42. The temperature fuse 43 is blown when the temperature exceeds a predetermined level, so as to stop a current from being supplied to the induction coil 42.

Figure 4A:
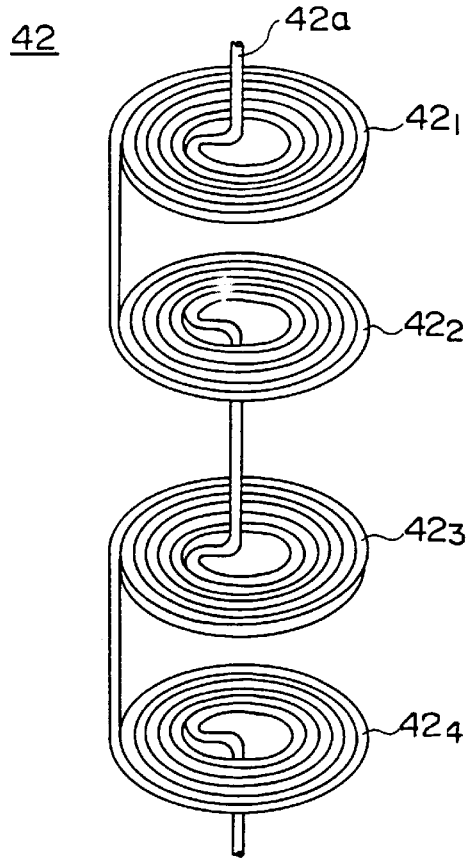
FIGS. 4A and 4B are diagrams explaining a construction of an induction coil of FIG. 3B.
Figure 4B:
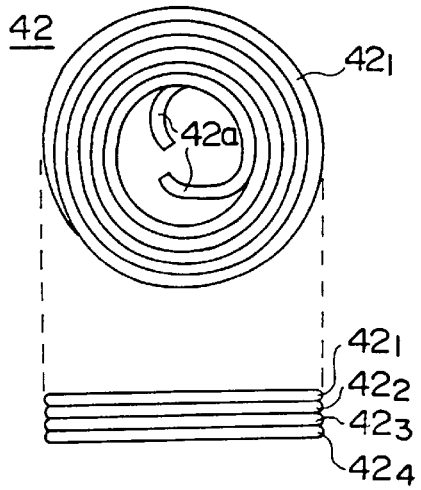

FIGS. 4A and 4B show a construction of the induction coil of FIG. 3B, FIG. 4A being an exploded view, and FIG. 4B being a set of a top view and a side view. As shown in FIG. 4A, the induction coil 42 is formed such that a first coil layer $\mathbf{42}_1$ is formed by winding, on a plane, a coil member 42*a* such as a wire member having a diameter of 0.8–1.0 mm so as to evolve outward, and a second coil layer $\mathbf{42}_2$ is formed by winding the coil member 42*a* so as to evolve inward, starting at the periphery of the first coil layer $\mathbf{42}_1$.

A third coil layer $\mathbf{42}_3$ is formed by winding the coil member 42*a* so as to evolve outward, starting at the center of the second coil layer $\mathbf{42}_2$. A fourth coil layer $\mathbf{42}_4$ is formed by winding the coil member 42*a* so as to evolve inward, starting at the periphery of the third coil layer $\mathbf{42}_3$. It will be assumed that the fourth coil layer $\mathbf{42}_4$ is the last layer.

As shown in FIG. 4B, the first through fourth coil layers $\mathbf{42}_1$–$\mathbf{42}_4$ are built upon each other. The coil member 42*a* is led out at the center of the first coil layer $\mathbf{42}_1$ and at the center of the fourth coil layer $\mathbf{42}_4$. As shown in FIGS. 3A and 3B, the induction coil 42 is bent and disposed in the holder 44.

It is generally known that heat generated in a central part of a coil is directly transferred to a peripheral part thereof, and the coil is cooled because heat dissipation is greater at the periphery than at the center. When heat conduction between the peripheral part and the central part is not effected efficiently, the central part of the coil is not cooled, resulting in a substantial increase in the temperature.

By leading out, at the center, the ends of the coil member 42*a* wound to form the first through fourth coil layers $\mathbf{42}_1$ and $\mathbf{42}_4$, as shown in FIGS. 4A and 4B, heat generated in the coil member 42*a* is dissipated outward so that a temperature rise is restrained.

Figure 5:
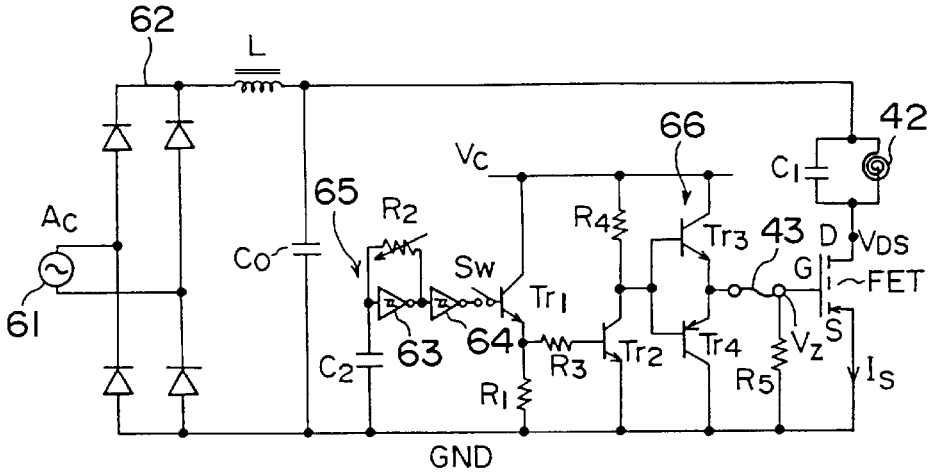
FIG. 5 is a circuit diagram of a circuit for driving the induction coil.
Figure 6A:
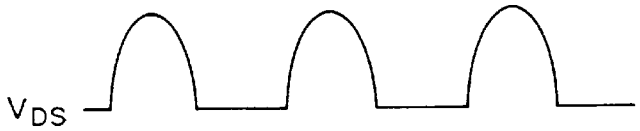
FIGS. 6A, 6B and 6C are waveform charts associated with essential parts of the circuit of FIG. 5.
Figure 6B:
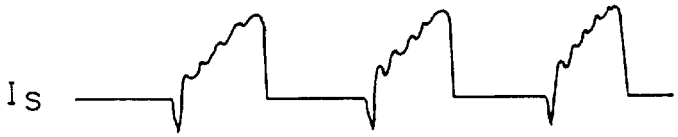
Figure 6C:
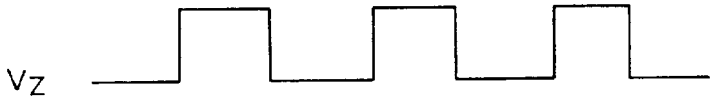

FIG. 5 is a circuit diagram of a circuit for driving the induction coil. FIGS. 6A, 6B and 6C are waveform charts associated with essential parts of the circuit of FIG. 5.

Referring to FIG. 5, an AC power supply source 61, a full-wave rectifier 62, a smoothing coil L, a smoothing capacitor Co, a parallel circuit comprising the induction coil 42 and a capacitor $C_1$, and a power MOS field-effect transistor (hereinafter, simply referred to as FET) constitute a closed circuit.

A power supply source Vc is grounded via an NPN transistor $Tr_1$ and a resistor $R_1$. The base of the transistor $Tr_1$ is biased by an output from a series of two Schmidt trigger inverters 63 and 64, a switch SW being provided between the Schmidt trigger inverter 64 and the transistor $Tr_1$. A capacitor $C_2$ is connected between the input terminal of the inverter 63 and the ground GND, and a variable resistor $R_2$ is connected between the input and output terminals of the inverter 63. Thus, an oscillator circuit 65 is formed by the inverter 63, the variable resistor $R_2$ and the capacitor $C_2$. An oscillation signal (driving pulse) is fed to the base of the transistor $Tr_1$ via the inverter 64 and the switch SW. The oscillator circuit 65, the inverter 64 and the switch SW are externally connected. The switch SW is provided to supply a current to the induction coil 42.

An emitter follower is formed by connecting the emitter of the transistor $Tr_1$ to the base of a NPN transistor $Tr_2$ via a resistor $R_3$. The collector of the transistor $Tr_2$ is connected to the power supply source Vc via a resistor $R_4$, and to the base of an NPN transistor $Tr_3$ and an NPN transistor $Tr_4$ which constitute an inverter 66. The output of the inverter 66 is connected to a gate G of the FET via the temperature fuse 43. The gate G of the FET is connected to the ground GND via a resistor $R_5$.

Assuming that the potential of the drain D of the FET is $V_{DS}$, the current flowing in the FET is $I_S$, and the potential of the gate G of the FET is $V_Z$, the associated waveform charts are shown in FIGS. 6A, 6B and 6C.

The driving circuit is operated such that the driving pulse fed via the switch SW turns the FET ON and OFF via the inverter 66. As a result, an inductance component of the induction coil 42 and a capacitance component of the capacitor $C_1$ generate a resonance (having the frequency of about 20 kHz–40 kHz in the case that the fixing roller 60 is made of iron). A magnetic flux fluctuation caused by a fluctuation of the current $I_S$ flowing in the induction coil 42 is applied to the fixing roller 60. Consequently, an eddy current is induced in the fixing roller 60, and, thus, the resistance of the fixing roller 60 causes heat to be generated.

When the temperature of the induction coil 42 rises abnormally, the temperature fuse 43 is blown, and the driving of the FET is stopped. Hence, the current supplied to the induction coil 42 is cut off.

The temperature of the fixing roller 60 is detected by a thermistor (not shown) and is controlled thereby to be at a preset level.

Figure 7:
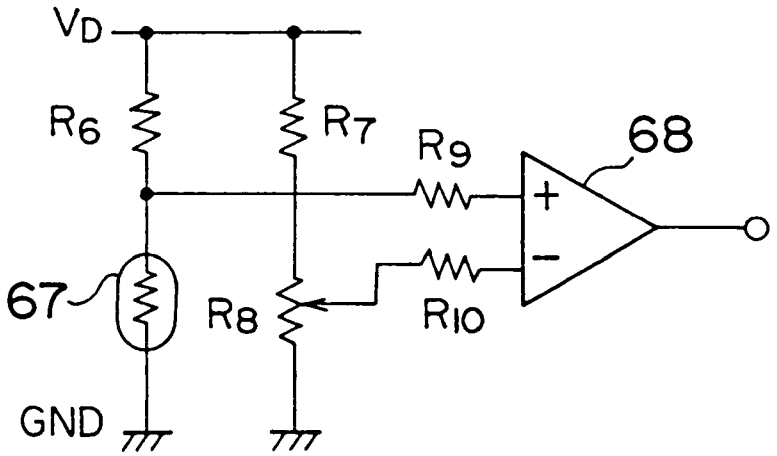
FIG. 7 is a circuit diagram of a temperature detection circuit using a thermistor to detect the temperature of the induction coil.

FIG. 7 is a circuit diagram of a temperature detection circuit using a thermistor to detect the temperature of the induction coil. In the circuit of FIG. 7, a thermistor is used as a means to control the temperature of the induction coil 42. Like the aforementioned temperature fuse 43, the circuit is provided adjacent to the induction coil 42.

Referring to FIG. 7, resistors $R_6$ and $R_7$, a variable resistor $R_8$ and a thermistor 67 form a bridge circuit between the power supply source $V_D$ and the ground GND. A junction between the resistor $R_6$ and the thermistor 67 is connected to the + input of a differential amplifier 68 via a resistor $R_9$, and a variable resistance arm of the variable resistor $R_8$ is connected to the − input of the differential amplifier 68 via a resistor $R_{10}$.

Temperature variation is detected by the thermistor 67 and is turned into variation of resistance. The resultant output from the differential amplifier 68 proportional to the variation of temperature controls a current supplied to the induction coil 42.

Figure 8A:
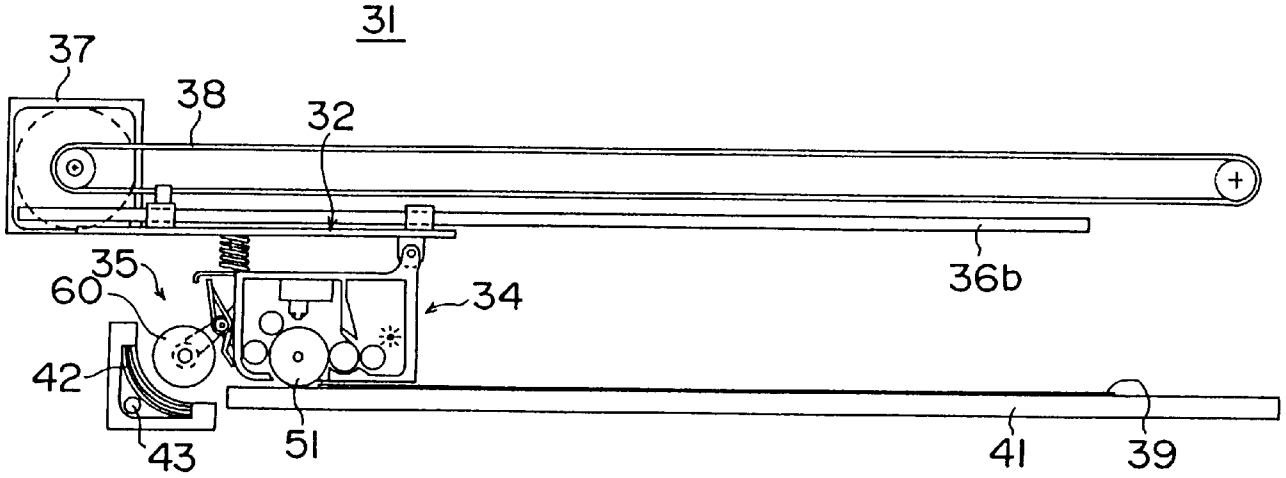
FIGS. 8A and 8B show how a fixing roller is heated.
Figure 8B:
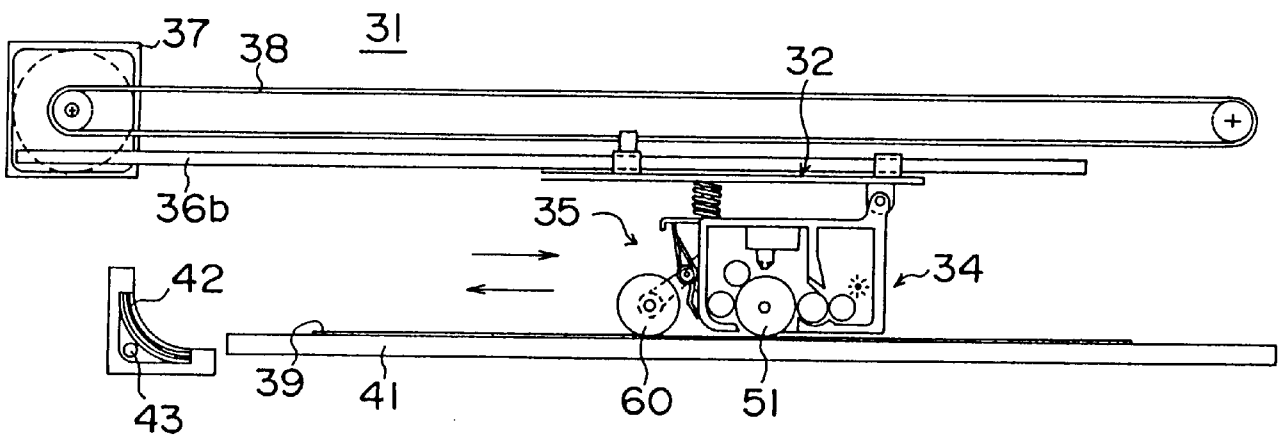

FIGS. 8A and 8B show how the fixing roller is heated. Referring to FIG. 8A, the fixing roller 60 is located near the induction coil 42 when the carriage 32 is at the home position. In this state, a current is fed to the induction coil 42 so that the fixing roller 60 is heated according to an induction heating process.

When the temperature of the fixing roller 60 reaches a predetermined level, the carriage 32 is translated on the recording paper 39 to effect electrophotographic printing and fixing. As shown in FIG. 8B, the carriage 32 returns from a print end position to a print start position, whereupon the recording paper 39 is transported by a predetermined amount to effect electrophotographic printing and fixing of a next line. The carriage 32 is made to reciprocate a predetermined number of times.

When the carriage 32 reciprocates the predetermined number of times, or when the temperature of the fixing roller 60 drops to such a level that the fixing cannot be properly performed, the carriage 32 is returned to the home position, and the fixing roller 60 is heated by the induction coil 42 by a degree commensurate with the degree that the temperature has dropped.

If the temperature of the induction coil 42 rises excessively high for some reason, the current supplied to the induction coil 42 is cut off by the temperature fuse 43 (or the thermistor 67). The temperature of the induction coil 42 is prevented from rising excessively due to the way it is wound.

To summarize the feature of the first embodiment, the way that the induction coil 42 is wound prevents the temperature of the coil 42 from rising excessively, and the temperature fuse 43 (or the thermistor) ensures that safety measures are taken in the event of an abnormal increase in the temperature of the induction coil 42.

Figure 9:
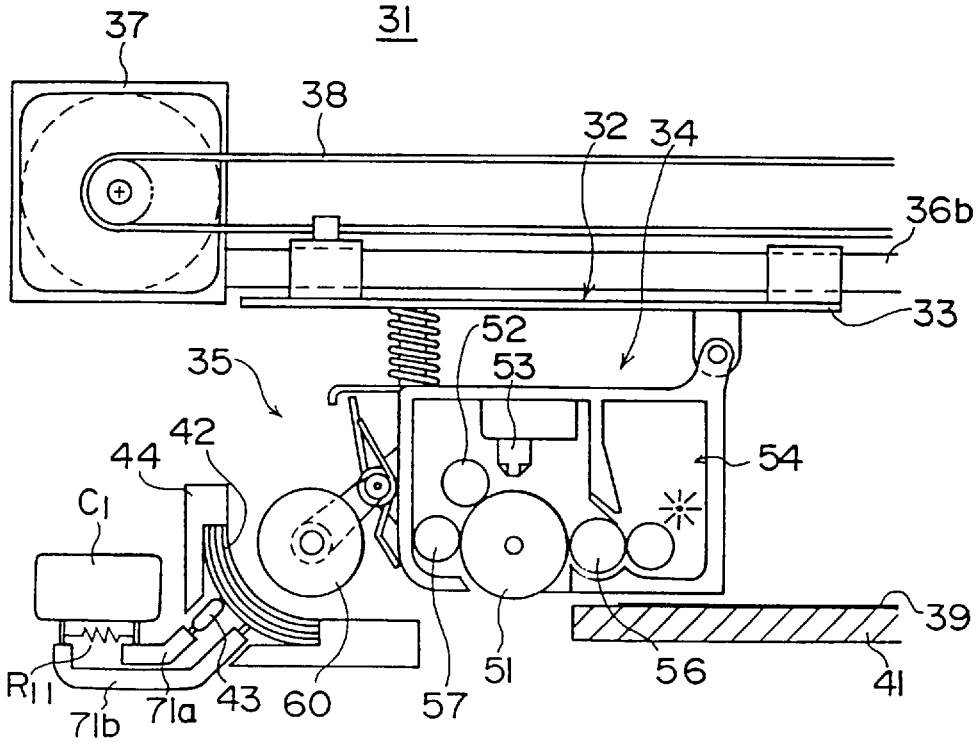
FIG. 9 shows a constitution of a second embodiment of the present invention.

FIG. 9 shows a constitution of a second embodiment of the present invention. In the serial electrophotographic printer 31 shown in FIG. 9, one end of the coil member 42*a* which end is led out of the coil 42 at the center is connected, via the temperature fuse 43, to a first end of a non-magnetic conductive member such as a copper plate 71*a* provided as a radiator means. The other end of the coil member 42*a* is connected to a first end of a copper plate 71*b*.

A parallel circuit composed of the capacitor $C_1$ (see FIG. 5) and a resistor $R_{11}$ (for use in discharging when the temperature fuse is blown) is connected across second ends of the copper plates 71*a* and 71*b*. The other aspects of the construction of the serial electrophotographic printer 31 remain the same as those of the printer shown in FIG. 3A. Further, the induction coil 42 of the second embodiment has the same winding structure shown in FIGS. 4A and 4B.

According to the second embodiment, since the copper plates 71*a* and 71*b* are connected to the induction coil member 42*a* led out at the coil 42 center characterized by a significant temperature rise, heat radiating capability is relatively high so that it is possible to satisfactorily restrain the temperature rise in the induction coil 42.

While the copper plates 71*a* and 71*b* are taken as examples of a non-magnetic conductive member, any material such as a thick copper wire can be used as long as it has a surface area greater than that of the coil member 42*a*.

Figure 10A:
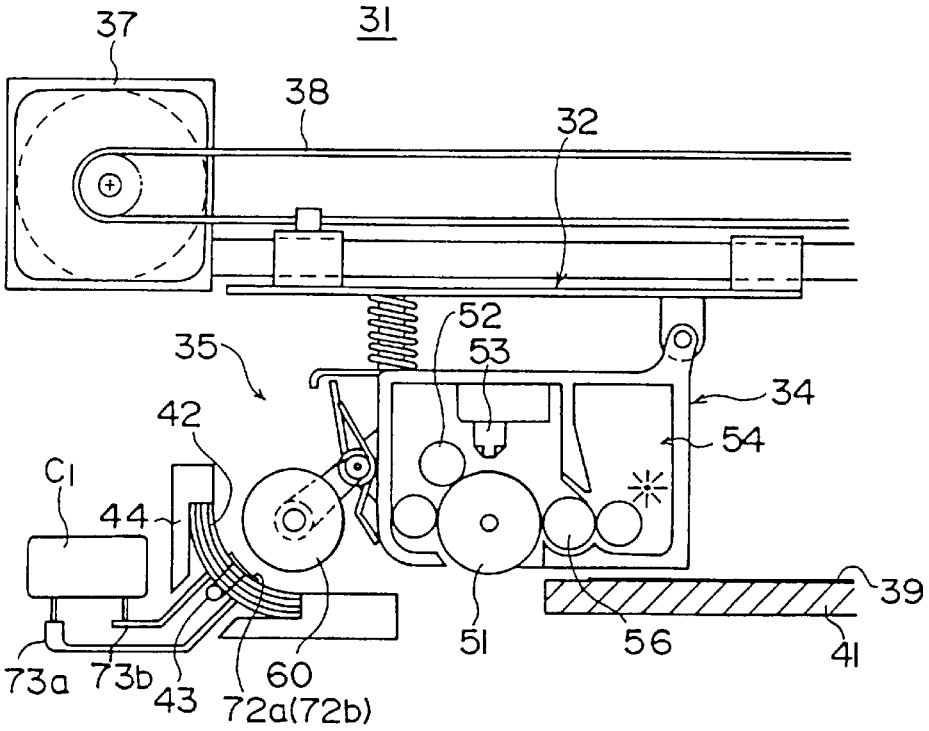
FIGS. 10A and 10B show a constitution of a third embodiment of the present invention.
Figure 10B:
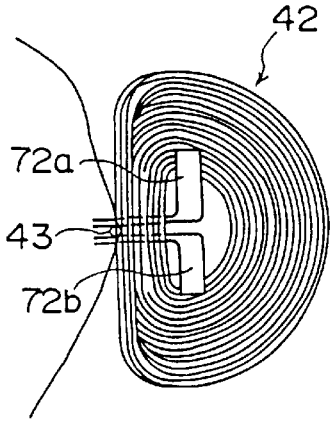

FIGS. 10A and 10B show a constitution of a third embodiment of the present invention. FIG. 10A is a cross-sectional view of the carriage and the heating member (induction coil), and FIG. 10B is a top view of the heating member. As shown in FIGS. 10A and 10B, the induction coil 42 having the same structure as that of the coil shown in FIGS. 4A and 4B has radiator plates 72*a* and 72*b* formed of, for example, an aluminum (known to be not heated when the resonance frequency is 20 kHz–40 kHz), the radiator plates 72*a* and 72*b* being provided at the center of the coil 42. The temperature fuse 43 (or thermistor) is provided between the radiator plates 72*a* and 72*b* to be in contact with the plates.

The two ends of the coil member 42*a* led out of the induction coil 42 are connected to ends of leads 73*a* and 73*b*, and the capacitor $C_1$ is connected across the other ends of the leads 73*a* and 73*b*. The remaining aspects of the serial electrophotographic printer remain the same as those of the printer shown in FIG. 3A.

According to the third embodiment, a normal temperature rise in the induction coil 42 is canceled due to heat dissipating activity of the radiator plates 72*a* and 72*b*, and current supply is stopped by the temperature fuse 43 in the event of an abnormal temperature increase, thus guaranteeing safety.

The present invention is not limited to the above described embodiments, and variations and modifications may be made without departing from the scope of the present invention.

What is claimed is:

1. A serial electrophotographic apparatus comprising:

transporting means for transporting recording paper;

a carriage equipped, at least, with processing means for exposing an image carrying body rotated about an axis parallel to a direction in which said recording paper is transported, forming a latent image by exposing a charged image carrying body, and developing said latent image to produce a visible image;

transferring means, provided in a position such that said recording paper is led through a space between said carriage and said transferring means, for transferring said visible image onto said recording paper as said carriage is being translated;

translating means for translating said carriage above said transferring means, in a direction perpendicular to said direction in which said recording paper is transported;

fixing means for fixing said visible image transferred onto said recording means by a heated fixing member;

a heating means for heating said fixing means; and temperature control means for detecting a temperature of said heating means and, upon detection of a rise in said temperature above a predetermined temperature, cutting off power to said heating means, thereby stopping said rise of said temperature of said heating means; and a multi-layer coil configuration having multiple coil layers which are serially connected, each multiple coil layer of said multiple coil layers being embodied by a flat winding, wherein a temperature distribution of said winding tends to be significantly higher towards a center of said winding than at a periphery of said winding and therefore to reduce said occurrence of an irregular heat distribution by leading out, at said center of said winding, ends of said multiple coil configuration so that heat generated in said multiple coil configuration is dissipated outwardly and a temperature rise is restrained.

2. The serial electrophotographic apparatus as claimed in claim 1, wherein said fixing means is mounted on said carriage, and said heating means is disposed near said fixing means when said carriage is at an initial position.

3. The serial electrophotographic apparatus as claimed in claim 1, wherein said heating means heats said fixing means in a non-contact manner according to an induction heating process.

4. The serial electrophotographic apparatus as claimed in claim 2, wherein said heating means heats said fixing means in a non-contact manner according to an induction heating process.

5. The serial electrophotographic apparatus as claimed in claim 1, wherein said temperature control means is disposed in a vicinity of a terminal of said heating means, and wherein a current supply to said heating means is stopped when said temperature exceeds a predetermined level.

6. The serial electrophotographic apparatus as claimed in claim 2, wherein said temperature control means is disposed in a vicinity of a terminal of said heating means, and wherein a current supply to said heating means is stopped when said temperature exceeds a predetermined level.

7. The serial electrophotographic apparatus as claimed in claim 3, wherein said temperature control means is disposed in a vicinity of a terminal of said heating means, and wherein a current supply to said heating means is stopped when said temperature exceeds a predetermined level.

8. The serial electrophotographic apparatus as claimed in claim 1, wherein said temperature control means controls a current supply to said heating means in response to said rise in said temperature detected in said heating means.

9. The serial electrophotographic apparatus as claimed in claim 2, wherein said temperature control means controls a current supply to said heating means in response to said rise in said temperature detected in said heating means.

10. The serial electrophotographic apparatus as claimed in claim 3, wherein said temperature control means controls a current supply to said heating means in response to said rise in said temperature detected in said heating means.

11. The serial electrophotographic apparatus as claimed in claim 1, wherein said heating means is formed by winding a wire member into a coil, and wherein radiator means is provided at a center of said coil.

12. The serial electrophotographic apparatus as claimed in claim 2, wherein said heating means is formed by winding a wire member into a coil, and wherein radiator means is provided at a center of said coil.

13. The serial electrophotographic apparatus as claimed in claim 3, wherein said heating means is formed by winding a wire member into a coil, and wherein radiator means is provided at a center of said coil.

14. The serial electrophotographic apparatus as claimed in claim 11, wherein said radiator means is a radiator plate which is a non-magnetic conductive member and which is electrically connected to a terminal of said heating means, said radiator means for supplying a current to said heating means, and said radiator means having a relatively large surface area, such that said radiator means both conducts current and radiates heat.

15. The serial electrophotographic apparatus as claimed in claim 12, wherein said radiator means is a radiator plate which is a non-magnetic conductive member and which is electrically connected to a terminal of said heating means, said radiator means for supplying a current to said heating means, and said radiator means having a relatively large surface area, such that said radiator means both conducts current and radiates heat.

16. The serial electrophotographic apparatus as claimed in claim 13, wherein said radiator means is a radiator plate which is a non-magnetic conductive member and which is electrically connected to a terminal of said heating means, said radiator means for supplying a current to said heating means, and said radiator means having a relatively large surface area, such that said radiator means both conducts current and radiates heat.

17. The serial electrophotographic apparatus as claimed in claim 11, wherein said temperature control means is provided in near said radiator means.

18. The serial electrophotographic apparatus as claimed in claim 12, wherein said temperature control means is provided near said radiator means.

19. The serial electrophotographic apparatus as claimed in claim 13, wherein said temperature control means is provided near said radiator means.

20. The serial electrophotographic apparatus as claimed in claim 14, wherein said temperature control means is provided near said radiator means.

21. The serial electrophotographic apparatus as claimed in claim 15, wherein said temperature control means is provided near said radiator means.

22. The serial electrophotographic apparatus as claimed in claim 16, wherein said temperature control means is provided near said radiator means.

23. A serial electrophotographic apparatus comprising:

transporting means for transporting recording paper;

a carriage equipped, at least, with processing means for exposing an image carrying body rotated about an axis parallel to a direction in which said recording paper is transported, for forming a latent image by exposing a charged image carrying body, and for developing said latent image to produce a visible image;

transferring means, provided in a position such that said recording paper is led through a space between said carriage and said transferring means, for transferring said visible image onto said recording paper as said carriage is being translated;

translating means for translating said carriage above said transferring means, in a direction perpendicular to said direction in which said recording paper is transported;

fixing means for fixing said visible image transferred onto said recording means by a heated fixing means; and a heating means for heating said fixing means in a non-contact member according to an induction heating process, said heating means being formed of a stack of a predetermined number of coil layers, each of said coil layers being formed by winding a wire on a plane; and a multi-layer coil configuration having said multiple coil layers which are serially connected, each multiple coil layer of said multiple coil layers being embodied by a flat winding, wherein a temperature distribution of said winding tends to be significantly higher towards a center of said winding than at a periphery of said winding and therefore to reduce said occurrence of an irregular heat distribution by leading out, at said center of said winding, ends of said multiple coil configuration so that heat generated in said multiple coil configuration is dissipated outwardly and a temperature rise is restrained.

24. The serial electrophotographic apparatus as claimed in claim 23, wherein said fixing means is mounted on said carriage, and said heating means is disposed near said fixing means when said carriage is at an initial position.

25. The serial electrophotographic apparatus as claimed in claim 23, wherein said heating means has said predetermined number of coil layers, and at least one end of an entirety of said coil layers is led out at a center of said coil layers.

26. The serial electrophotographic apparatus as claimed in claim 24, wherein said heating means has said predetermined number of coil layers, and at least one end of an entirety of said coil layers is led out at a center of said coil layers.

* * * * *